US009255424B1

(12) United States Patent
Dorlac

(10) Patent No.: US 9,255,424 B1
(45) Date of Patent: Feb. 9, 2016

(54) DOOR JAMB MOUNTED DOOR LOCK

(71) Applicant: Ginard W. Dorlac, Fenton, MO (US)

(72) Inventor: Ginard W. Dorlac, Fenton, MO (US)

( * ) Notice: Subject to any disclaimer, the term of this patent is extended or adjusted under 35 U.S.C. 154(b) by 0 days.

(21) Appl. No.: 14/589,266

(22) Filed: Jan. 5, 2015

(51) Int. Cl.
*E05C 5/04* (2006.01)
*E05B 15/00* (2006.01)
*E05B 15/02* (2006.01)

(52) U.S. Cl.
CPC ..... *E05B 15/00* (2013.01); *E05B 15/0006* (2013.01); *E05B 15/02* (2013.01); *E05B 2015/023* (2013.01); *E05B 2015/0215* (2013.01); *Y10T 292/68* (2015.04); *Y10T 292/705* (2015.04); *Y10T 292/707* (2015.04)

(58) Field of Classification Search
CPC ..... E05C 5/04; E05B 15/025; E05B 15/00; E05B 15/0006; E05B 15/02; E05B 2015/0215; E05B 2015/023; E05B 2015/0235; Y10T 292/68; Y10T 292/705; Y10T 292/707
USPC ..... 70/140, 203, 212, 232; 292/251, 340, 292/341.18, 341.19
See application file for complete search history.

(56) References Cited

U.S. PATENT DOCUMENTS

| | | | | | |
|---|---|---|---|---|---|
| 798,548 | A | * | 8/1905 | Wheeler | 292/251 |
| 1,354,625 | A | | 10/1920 | Segal | |
| 2,256,100 | A | | 9/1941 | Megela | |
| 2,326,282 | A | | 8/1943 | Bierenfeld | |
| 2,458,046 | A | | 1/1949 | Audet | |
| 2,810,600 | A | * | 10/1957 | Marron | 292/357 |
| 3,071,957 | A | | 1/1963 | Golub | |
| 3,279,838 | A | * | 10/1966 | Hamilton | 292/251 |
| 3,496,742 | A | * | 2/1970 | Beard et al. | 70/232 |
| 3,550,412 | A | * | 12/1970 | Silverman et al. | 70/461 |
| 3,564,879 | A | | 2/1971 | Bennett | |
| 4,414,829 | A | | 11/1983 | Nielsen, Jr. et al. | |
| 4,660,873 | A | | 4/1987 | Sholund | |
| 4,669,282 | A | | 6/1987 | Hoyt et al. | |
| 4,974,888 | A | * | 12/1990 | Childers | 292/251 |
| 4,993,247 | A | * | 2/1991 | Minemura | 70/208 |
| 5,079,935 | A | * | 1/1992 | Zaucha | 70/140 |
| 5,106,251 | A | * | 4/1992 | Steinbach | 411/433 |
| 5,154,461 | A | * | 10/1992 | Prescott et al. | 292/346 |
| 5,171,050 | A | * | 12/1992 | Mascotte | 292/341.18 |
| 5,666,831 | A | | 9/1997 | Doros | |
| 5,799,521 | A | | 9/1998 | Kennedy | |
| 6,364,377 | B1 | * | 4/2002 | Ferguson | 292/175 |
| 6,428,061 | B1 | * | 8/2002 | Daoud | 292/251 |
| 6,684,669 | B1 | * | 2/2004 | Talpe | 70/107 |
| 7,347,069 | B2 | * | 3/2008 | Talpe | 70/107 |

FOREIGN PATENT DOCUMENTS

| | | |
|---|---|---|
| GB | 2228527 | 8/1990 |

* cited by examiner

*Primary Examiner* — Lloyd Gall
(74) *Attorney, Agent, or Firm* — Grace J. Fishel

(57) ABSTRACT

A lock mechanism for use with a swinging door on hinges with no outside key involved. A fixture is affixed to the door frame opposite the hinges. A through bore allows a rod with a handle at one end and threads at the opposite end to pass through the door and be threaded into a threaded aperture in the fixture to prevent hinged movement of the door. The parts may be cadmium plated for corrosion protection.

7 Claims, 6 Drawing Sheets

DOOR JAMB MOUNTED DOOR LOCK

BACKGROUND OF THE INVENTION

1. Field of the Invention

The present invention provides a door locking system for providing greatly enhanced security and peace of mind.

2. Brief Description of the Prior Art

Most criminals are looking for an easy hit; a house that they can break into quickly. Dead bolts are the most common way to provide additional lock security but have not proven wholly satisfactory in use. With a dead bolt, the lock mechanism is secured to the inside of the door on the side of the door opposite from its hinged side. A dead bolt is slidably mounted within the lock mechanism and, in its locking position, extends through a strike plate and into the door jamb. One problem with dead bolts is that the security provided by the lock is limited by the short distance that the bolt extends into the jamb such that the door is subject to being kicked in or pushed open by a man running his shoulder into it.

Dead bolts are also susceptible to a practice called "lock bumping." To bump a lock, a thief will insert a special key called a bump key into the dead bolt, then tap on it with a blunt object like the handle of a screwdriver. The bump key transfers the force of the bumps into the lock's pins, jolting them into an unlocked position without damaging the lock or leaving any trace of a forced entry.

Most burglars spend only a few minutes trying to break inside. While there is no way to secure a home completely from a sophisticated or determined burglar, a locking system that makes it more difficult to break inside would be desirable.

BRIEF SUMMARY OF THE INVENTION

In view of the above, it is an object of the present invention to provide a locking system that greatly decreases the chance of a break in. It is another object to provide a locking system that is easy to lock and release. A further object is to provide a locking system that is inexpensive to make from readily available materials. It is also an object to provide a locking system that can be secured on the inside also. Other objects and features of the invention will be in part apparent and in part pointed out hereinafter.

In accordance with the invention, a locking system is disclosed for a swinging door on hinges in a door jamb having a jamb door stop against which the door is closed. The locking system includes a fixture capable of attachment to the framing members of the door jamb opposite the hinges with lag screws; and, a rod with a handle at end and threads at the opposite end. The rod is capable of sliding passage in a through bore in the door aligned with a threaded aperture in the fixture. In use, the door is secured in a closed position against the door jamb when the rod is passed through the through bore and threaded into the aperture in the fixture by the handle.

In some embodiments the fixture is formed of square tubing with end caps and two vertically aligned apertures on a jamb side of the tubing for attachment of the fixture with the lag screws. The tubing has apertures in a side of the tubing opposite the jamb side of the tubing aligned with the keyhole slots for accessing the lag screws through said aligned apertures. Other embodiments have end caps formed of square tubing and telescopingly received in opposite ends of the tubing with a cutout for collaring a head of the lag screw adjacent the jamb side of the tubing. Also disclosed are embodiments wherein a mounting plate is provided between the jamb side of the tubing and the jamb and face plates on an inside and an outside of the door with openings in registry with the through bore.

In a particular locking system for a swinging door on hinges in a door jamb with jamb door stop against which the door is closed, the locking system includes a fixture and a rod as further described. The fixture is mounted on the jamb door stop opposite the hinges with a jamb side of the fixture aligned with a jamb side edge of the jamb door stop. The fixture is formed of square tubing with end caps and two vertically aligned keyhole slots on a jamb side of the tubing for attachment of the fixture to the door jamb with lag screws and with apertures in a side of the tubing opposite the jamb side of the tubing. The apertures are aligned with the keyhole slots for accessing the lag screws. The end caps are formed of square tubing and are telescopingly received in opposite ends of the tubing with cutouts on the jamb side of the tubing for collaring the heads of the lag screws. The rod has a T-handle at a first end and threads at a second opposite end and passes through a through bore in the door, positioned above or below an existing doorknob and aligned with a threaded aperture in the fixture.

Some embodiments may include a pin for securing the locked door from the inside, said pin passing through an aperture in the handle and received in a recess in the door. With the pin extending through the handle and having an aperture between the handle and the recess through which a shackle of a padlock may be passed the removal of the pin is prevented by the shackle of the padlock when the padlock is locked. A punch may be provided that when threaded in the threaded aperture in the fixture may be used to make a punch mark on the outside of the door for locating the position of the through bore.

The invention summarized above includes the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
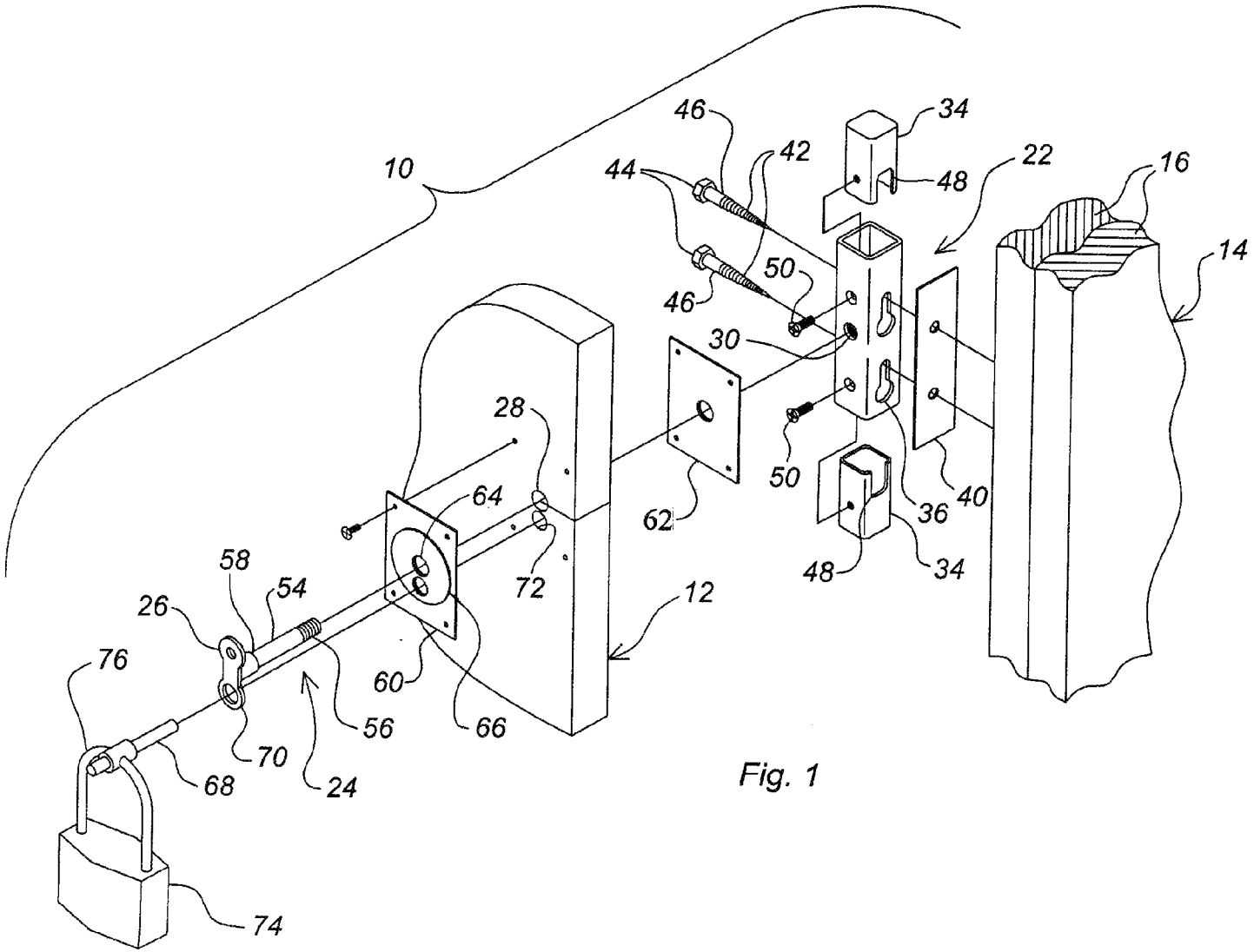
FIG. 1 is an exploded perspective view of a locking system in accordance with the present invention.
Figure 2:
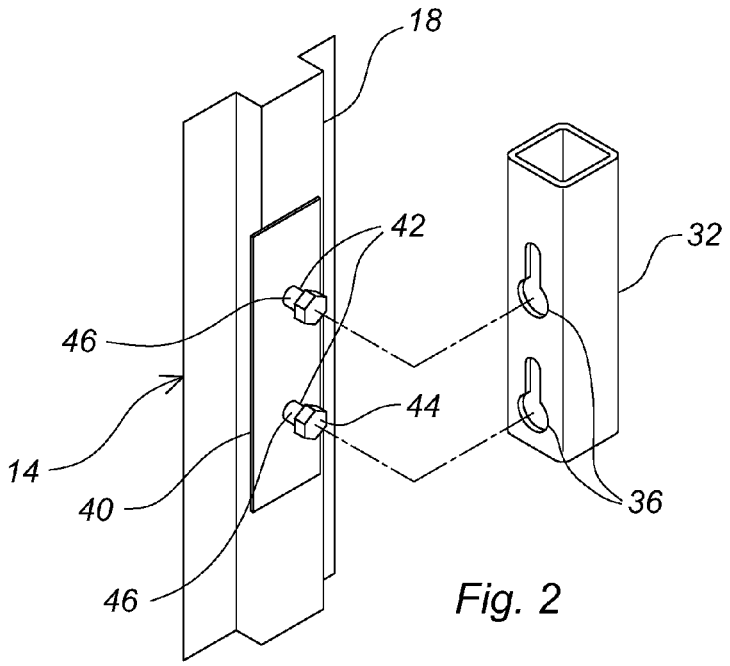
FIG. 2 is an exploded perspective view of a fixture and mounting plate with lag screws by which the fixture may be attached to a door jamb.
Figure 3:
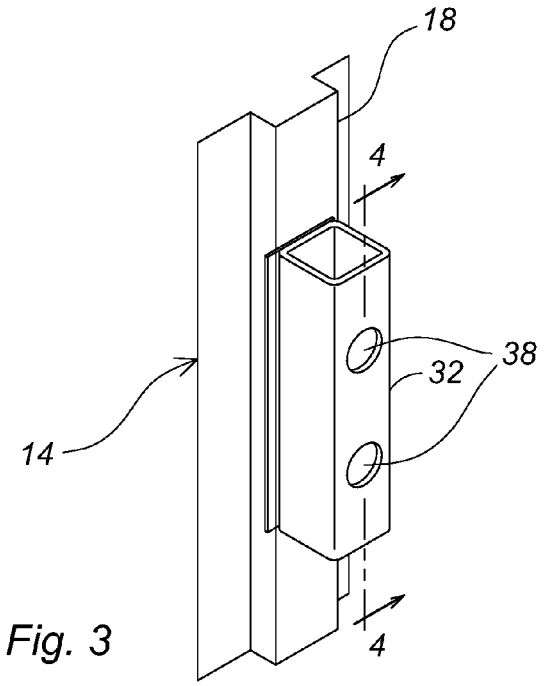
FIG. 3 shows the fixture attached to the door jamb.
Figure 4:
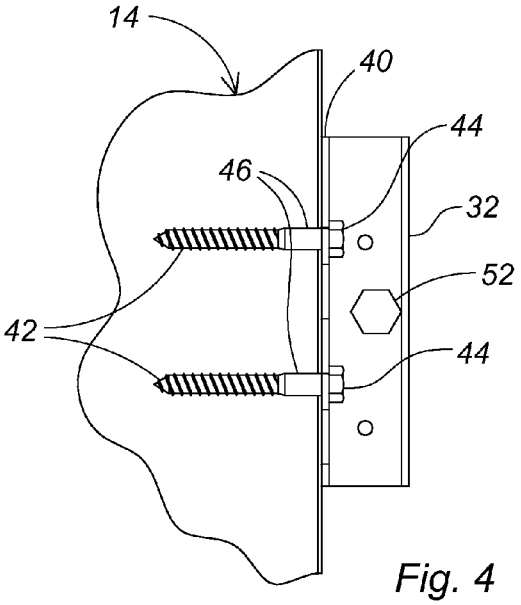
FIG. 4 is a cross section taken along the plane of 4-4 in FIG. 3.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the drawings more particularly by reference character, reference numeral 10 refers to a locking system for a hinged door 12 of the type commonly found in residential dwellings. Hinged door 12 is mounted within in a door jamb 14 formed by framing members 16. The framing members are typically constructed from two-by-four wooden studs secured side-by-side on either side of the door opening. A door jamb stop 18 is provided around the sides and top of jamb 14 against which an outer side 20 of door 12 closes.

Door locking system 10 in major part includes a fixture 22 and a threaded rod 24 with a handle 26 illustrated as a T-handle. Fixture 22 is capable of attachment to the framing members making up jamb 14 opposite hinges for supporting hinged door 12. Threaded rod 24 is capable of sliding through a through bore 28 provided in door 12 aligned with a threaded aperture 30 in fixture 22. Door 12 is secured in a closed position against door jamb stop 18 when threaded rod 24 is passed through bore 28 and threaded into threaded aperture 30 in fixture 22 as more particularly described below.

Figure 7:
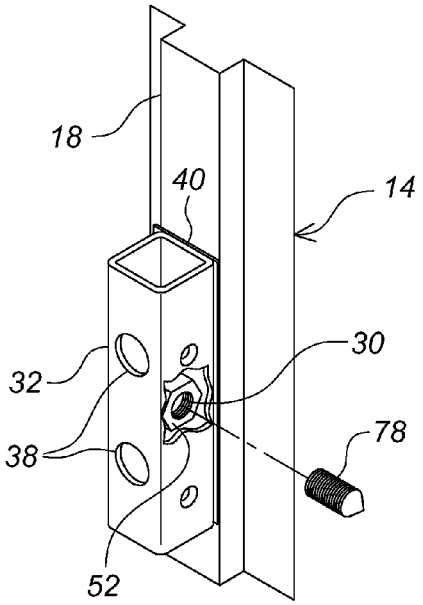
FIG. 7 is a perspective view of a punch threaded into a threaded aperture in the fixture.

As best seen in FIGS. 1-4, fixture 22 is formed of square tubing 32 and is provided with end caps 34 (FIG. 1). One or more keyhole slots 36 preferably aligned vertically are provided on a jamb side of tubing 32 and apertures 38 are provided on an opposing side of tubing 32 in alignment with keyhole slots 36. To reinforce the jamb, a mounting plate 40 is attached to framing members 16 (studs) with lag screws 42 by which fixture 22 is hung on jamb 14 and is preferably positioned such that a door side of tubing 32 is aligned with a rear edge of door jamb stop 18 (FIG. 7). For attachment of fixture 22 to jamb 14, heads 44 of lag screws 42 pass through wider ends of keyhole slots 36. With fixture 22 hanging on shanks 46 in narrower ends of keyhole slots 36, lag screws 42 are tightened with a tool reaching though apertures 38 such that screws 42 bite into framing members 16 and fixture 22 is securely mounted to jamb 14. End caps 34 formed of smaller sized square tubing are telescopingly received in opposite ends of tubing 32. A cutout 48 for collaring head 44 of lag screw 42 is provided at the open end of each end cap 34 adjacent the jamb side. End caps 34 are secured in tubing 32 with set screws 50 provided on door side of tubing 32. End caps 34 block apertures 38 and overlie and conceal heads 44 of lag screws 42. Thus a tool cannot be used to remove lag screws 42 and release fixture 22 from jamb 14. Threaded aperture 30 for use with threaded rod 24 is provided on door side of tubing 32 between lag screws 42. For increased security, a nut 52 (FIGS. 4 and 7) may be welded on the inside of tubing 32 to increase the number of turns of threads into which threaded rod 24 is threaded and thereby increase the shear strength of the connection.

Through bore 28 is drilled through door 12 at right angles to the door surfaces either above or below an existing doorknob. Threaded rod has a shank 54 portion and a threaded end portion 56 and handle 26 has an abutment shoulder 58. Shank 54 is slightly smaller in diameter than through bore 28 such that threaded rod 24 slides easily in through bore 28 without binding. Face plates 60 and 62 may be installed over through bore 28 by means of four mounting screws (not shown) on the inside and outside of door 12, respectively, with openings 64 in registry with through bore 28. In locking position, threaded end portion 56 is received in cooperating internal threads of nut 52 while further outward movement of threaded rod 24 through door 12 is stopped by abutment shoulder 58 against face plate 60. A circular keeper plate 66 may be provided on top of face plate 60 on the inside of door or used in place of face plate 60. Keeper plate 66 may be preferred over rectangular plate 60 for ease of aesthetic alignment with the side edges of door 12.

To prevent removal of locking system 10 from the inside a locking pin 68 may be provided as shown in FIG. 1. Pin 68 is passed through an aperture 70 in T-handle 26 and an aperture in keeper plate 66 and is received in a recess 72 drilled into door 12. A padlock 74 or the like may then be attached to locking pin 68 by passing a shackle 76 through a lateral channel formed in pin 68 after pin 68 is received in recess 72 and closing the lock. Removal of the pin 68 is prevented by shackle 76 which cannot pass through aperture 70 in T-handle 26.

In a typical embodiment, tubing 32 is 1½ inches by 1½ inches with a wall thickness of ⅛ inch and end caps 34 are 1¼ inch by 1¼ inch with a wall thickness of ⅛ inch. Mounting plate 40 is formed of 3/22 inch steel plate and face plates 60 and 62 are formed of 18 gauge sheet metal. Threaded rod 24 is formed from a ½ inch diameter grade 9 bolt having a dry torque of 128 ft/lb from which the head is removed and handle 26 with abutment shoulder 58 attached. Nut 52 which is welded inside fixture 22 is a ½ inch nut and lag screws 42 are 3 inch by ⅜ inch 304 stainless steel with a tensile strength of 100,000 to 125,000 psi. The parts may be cadmium plated for corrosion protection.

Figure 6:
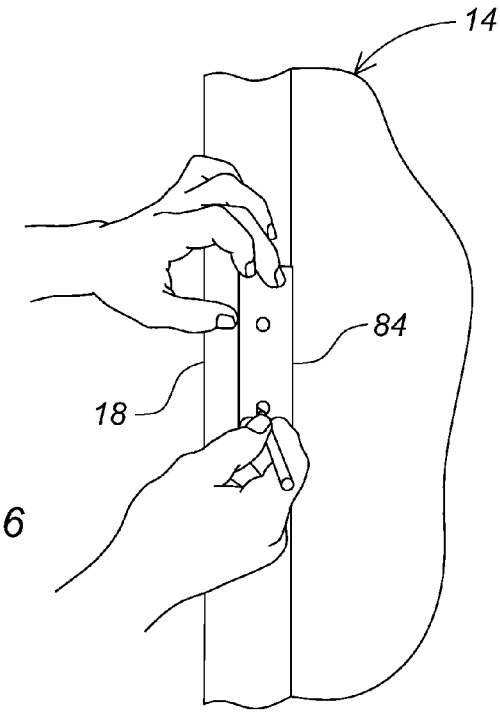
FIG. 6 shows the template in use in marking the holes for the lag screws on the jamb.

In use, fixture 22 may be attached to jamb 14 as shown in FIGS. 2-5 and described above. A template 84 (FIGS. 5 and 6) may be provided for locating the placement of mounting plate 40. With the door shut, template 84 is positioned on door jamb 14 with an inside edge, the two holes for lag screws 42 are marked in jamb 14 with a center punch. Two 13/16 inch pilot holes are drilled in the marked holes, ¼ inch deep so that lag screws 42 will not split the wood in door jamb stop 18 when tightened. About ⅜ inch of shank 46 is left showing on lag screws 42. End caps 34 are removed and tubing 32 slid onto lag screws 42 and lag screws 42 then driven into jamb 14 until just snug. End caps 34 are then reinstalled and secured with set screws 50.

Figure 8:
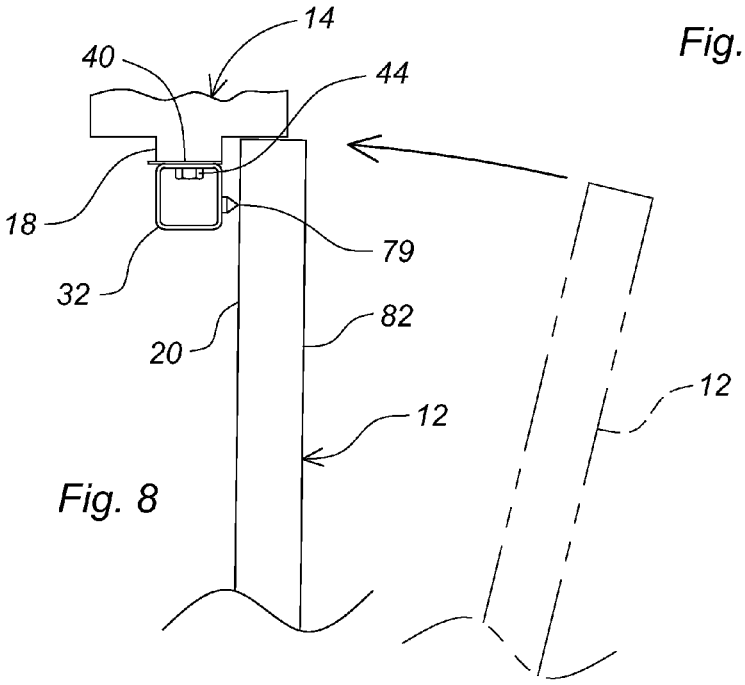
FIG. 8 is a top view of a door partially broken away showing the punch making a punch mark on the outside of the door to locate proper placement of the through bore in the door.
Figure 5:
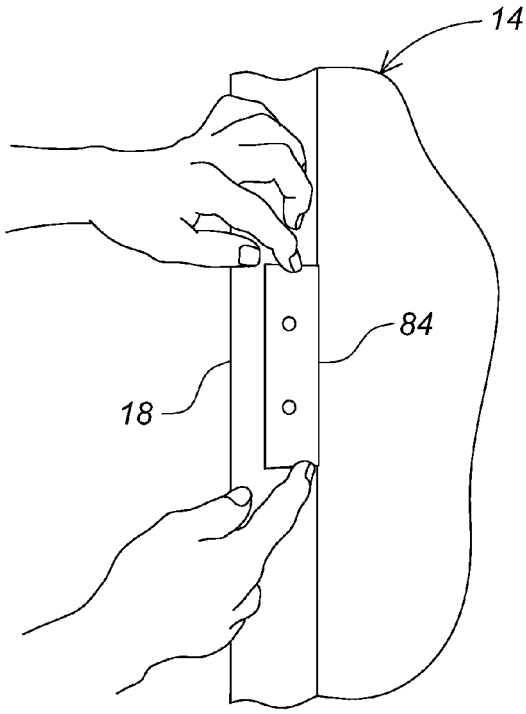
FIG. 5 shows a first template for locating the holes for the lag screws.
Figure 9:
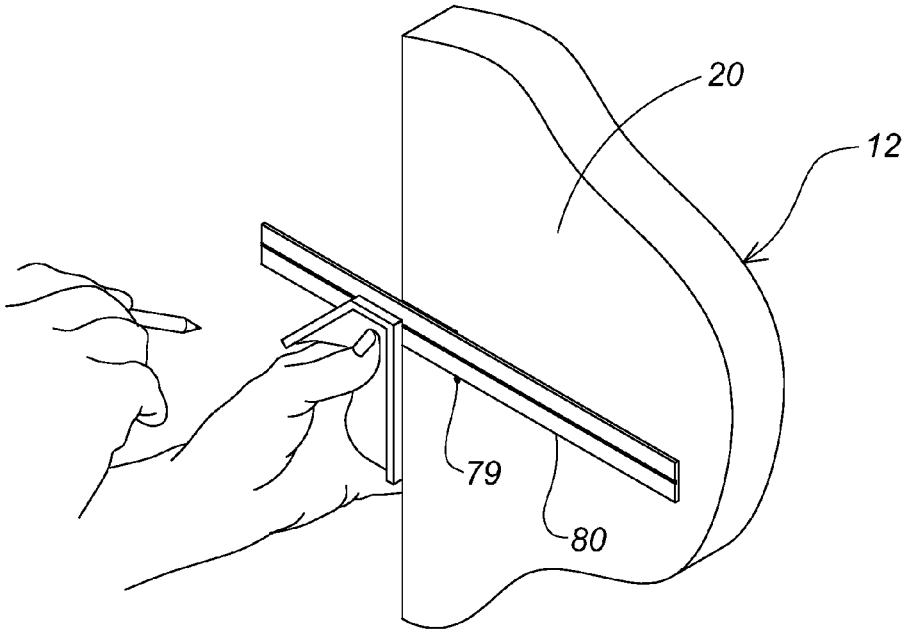
FIG. 9 shows a T-square in use in transferring the punch mark on the front of the door to the back of the door.
Figure 10:
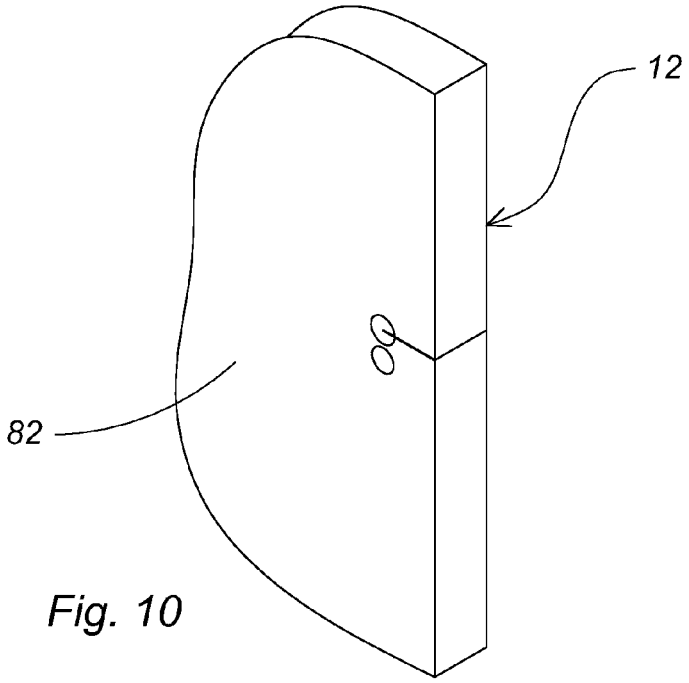
FIG. 10 is a perspective view of the inside of the door with a through bore and a recess.
Figures 11, 12:
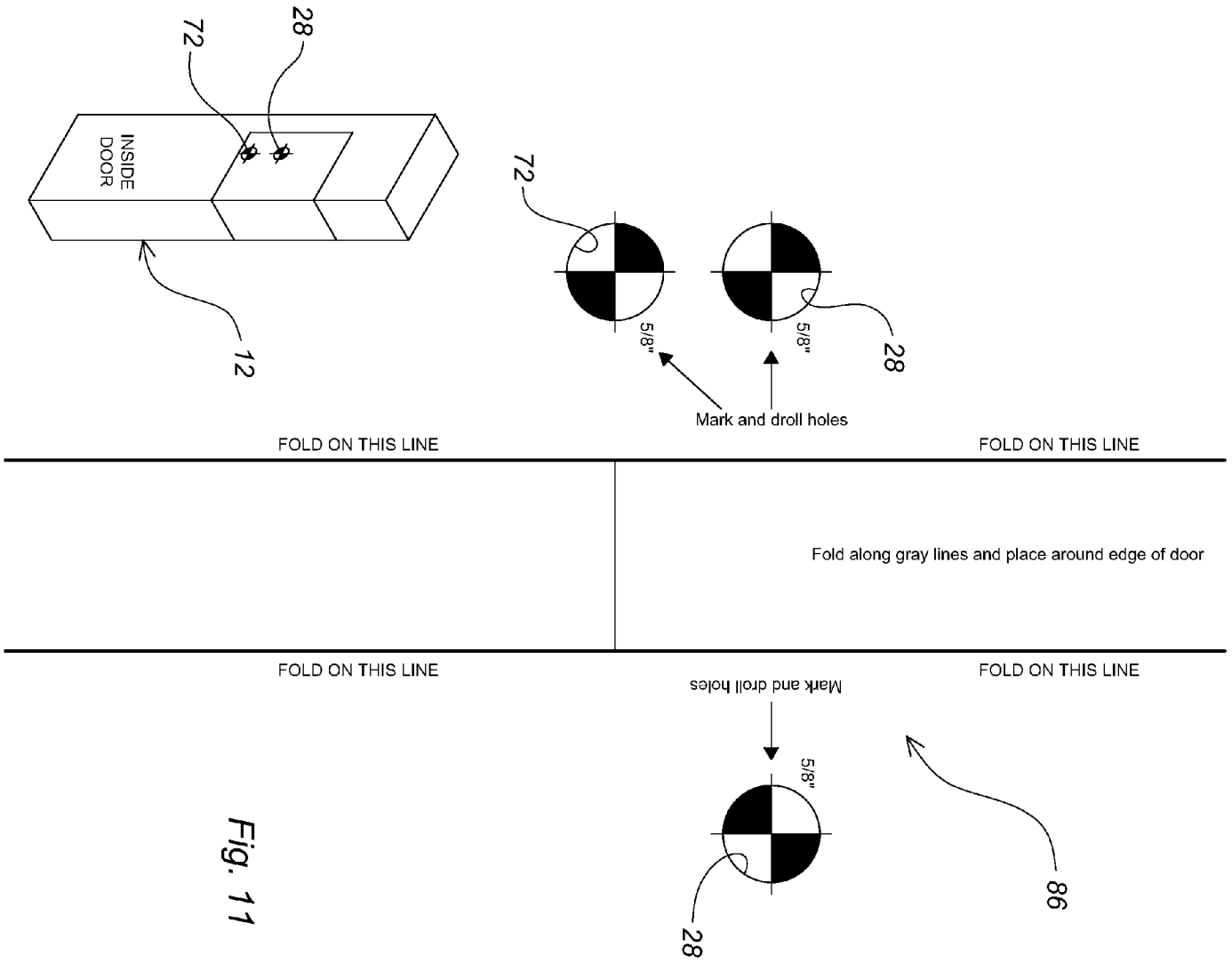
FIG. 11 is plan view a second template for use in locating the proper placement of the through bore in the door; and, FIG. 12 is a perspective view of the second template installed on the door for use in locating the through bore.

Door 12 may then be opened to determine the location of through bore 28 as follows: A punch 78 is threaded into threaded aperture 30 in fixture 22 (FIG. 7) and door 12 closed leaving a punch mark 79 on outside 20 of door 12 (FIG. 8). A T-square 80 as shown in FIG. 9 may be used to locate the punch mark on the inner side 82 of door 12. If locking pin 68 is being used, a mark ¾ inch is made below punch mark and a ⅝ inch recess 72 is drilled 1⅜ deep. At the punch mark on outer side 20 and inner side 82 of door 12, a 11/16 inch hole is drilled through the door. For best results, it may be desirable to drill from both sides of door 12 to get through bore 28 as straight as possible. With through bore 28 drilled, threaded rod 24 may be passed through bore 28 and threaded into threaded aperture 30 in fixture 22 and tightened until snug. Inside face plate 60 may be adjusted so that threaded rod 24 turns smoothly in through bore 28 and then attached with screws. In like manner outside face plate 62 may be positioned by taping, leveling and testing with door 12 closed before putting in the screws. In place of T-square, a paper template 86 may be provided as shown in FIG. 11. The center of through bore 28 is located over the punch mark made by punch 78 and the template wrapped around door 12 as shown in FIG. 12 to locate the corresponding punch mark. Through bore 28 and recess 72 are drilled as described above.

With door 12 closed, door locking system 10 may be engaged by threading threaded rod 24 into threaded aperture 30 in fixture 22 until abutment shoulder 58 is stopped against face plate 60. If the lock is to be secured from the inside also, locking pin 68 is passed through handle 26 and into recess 72 and padlock 74 attached. When it is desired to open door 12, a person on the inside of the dwelling merely has to remove padlock 74 and locking pin 68 (if present) and reverse the rotation of handle 26. Within a few turns, threaded rod 24 is freed from threaded aperture 30, at which point door 12 may be opened in the normal way.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill Hence as various changes could be made in the above constructions without departing from the scope of the invention, it is intended that all matter contained in the above description or shown in the accompanying drawings shall be interpreted as illustrative and not in a limiting sense.

What is claimed:

1. A locking system adapted for attachment to a swinging door on hinges in a door jamb, said door jamb including framing members and a jamb door stop against which the door is closed, said locking system comprising:

a fixture configured for attachment to the framing members of the door jamb opposite the hinges with lag screws;

said fixture formed of square tubing with end caps and two vertically aligned keyhole slots on a first side of the square tubing for attachment of the fixture to the framing members with the lag screws, said square tubing having apertures in a second side of the square tubing opposite the first side of the square tubing, said apertures aligned with the keyhole slots for accessing the lag screws through said aligned apertures; and, a rod with a handle at one end and threads at an opposite end, said rod configured to be slidingly passed through a bore in the door aligned with a threaded aperture in the fixture;

whereby a door is secured in a closed position against the door jamb when the rod is passed through the through bore and threaded into the threaded aperture in the fixture by the handle.

2. The system of claim 1 wherein the end caps are formed of square tubing and are telescopingly received in opposite ends of the square tubing and have a cutout for collaring a head of the lag screw adjacent the first side of the square tubing.

3. The system of claim 1 wherein a mounting plate is provided between the first side of the square tubing and the jamb.

4. The system of 1 wherein a face plate is provided on an inside and an outside of the door with openings configured to be in registry with the through bore.

5. A locking system adapted for attachment to a swinging door on hinges in a door jamb, said swinging door having a doorknob opposite the hinges, said door jamb including a jamb door stop against which the door is closed, said locking system comprising a fixture configured to be mounted on the door jamb opposite the hinges, said fixture having a first side of the fixture aligned with the jamb door stop, said fixture formed of square tubing with end caps and two vertically aligned keyhole slots on the first side of the square tubing for attachment of the fixture to the door jamb with lag screws, said square tubing having apertures in a second side of the square tubing opposite the first side of the square tubing, said apertures aligned with the keyhole slots for accessing the lag screws, said end caps formed of square tubing and telescopingly received in opposite ends of the square tubing and having cutouts on the first side of the square tubing for collaring the heads of the lag screws, a rod with a T-handle at a first end and threads at a second opposite end, said rod configured to be passed through a through bore in the door aligned with a threaded aperture in the fixture, said through bore provided above or below the doorknob;

whereby a door is secured in a closed position against the door jamb when the rod is passed through the through bore and threaded into the threaded aperture in the fixture by rotation of the handle.

6. The system of claim 5 further adapted for use with a door having an inside and an outside said system including a pin for securing the locked door from the inside, said pin passing through an aperture in the handle and received in a recess in the door, said pin extending from the handle and having an aperture between the handle and the recess through which a shackle of a padlock is passed whereby removal of said pin is prevented by the shackle of the padlock when the padlock is locked.

7. The system of claim 5 further adapted for use with a door having an inside and an outside said system including a punch which when threaded in the threaded aperture in the fixture is configured to make a punch mark on the outside of the door for locating the position of the through bore.

* * * * *